US009425553B2

(12) United States Patent
Brown

(10) Patent No.: US 9,425,553 B2
(45) Date of Patent: Aug. 23, 2016

(54) CORD COUPLING SECUREMENT DEVICE

(71) Applicant: Blair Brown, Brampton, CA (US)

(72) Inventor: Blair Brown, Brampton, CA (US)

( * ) Notice: Subject to any disclaimer, the term of this patent is extended or adjusted under 35 U.S.C. 154(b) by 0 days.

(21) Appl. No.: 14/980,807

(22) Filed: Dec. 28, 2015

(65) Prior Publication Data

US 2016/0111820 A1 Apr. 21, 2016

Related U.S. Application Data

(63) Continuation-in-part of application No. 14/308,892, filed on Jun. 19, 2014, now Pat. No. 9,276,359.

(51) Int. Cl.
*H01R 4/66* (2006.01)
*H01R 13/639* (2006.01)

(52) U.S. Cl.
CPC ..... *H01R 13/6392* (2013.01)

(58) Field of Classification Search
CPC ..... H01R 4/64; H01R 13/65802
USPC ..... 439/92, 98, 99, 100, 95, 939, 497, 579
See application file for complete search history.

(56) References Cited

U.S. PATENT DOCUMENTS 4,183,603 A 1/1980 Donarummo
4,206,961 A 6/1980 Cifalde
4,664,463 A 5/1987 Carmo
4,843,686 A * 7/1989 Bartholomew ..... F16L 33/12 24/19
4,907,984 A 3/1990 Keller
4,917,626 A 4/1990 Barton
4,936,530 A * 6/1990 Wollar ..... F16B 2/12 248/68.1
4,957,450 A 9/1990 Pioszak
5,104,397 A * 4/1992 Vasconcelos ..... B25B 7/14 606/206
5,159,728 A * 11/1992 Bingold ..... E05B 75/00 24/16 PB
5,167,524 A 12/1992 Falcon
D340,695 S 10/1993 Merriman et al.
5,306,176 A 4/1994 Coffey
7,407,405 B1 * 8/2008 Slenczka ..... H01R 13/6392 439/369

FOREIGN PATENT DOCUMENTS

WO WO9528023 A1 10/1995

* cited by examiner

*Primary Examiner* — Phuongchi T Nguyen

(57) ABSTRACT

A cord connection securement device prevents electrical cords from being unintentionally uncoupled. The device includes a planar, flexible, L-shaped cable tie. Apertures extend through a first arm and openings extend through a second arm of the cable tie. A first hook extends from the second arm for being engaged to a selectable one of the apertures of an adjacently positioned second cable tie. A second hook extends from the second arm proximate a junction between the first arm and the second arm such that the second hook is engageable to one of the openings to form a loop configured for extending around an electrical cord adjacent to a plug of the electrical cord such that the plug is prevented from passing through the loop.

16 Claims, 4 Drawing Sheets

CORD COUPLING SECUREMENT DEVICE

BACKGROUND OF THE DISCLOSURE

Field of the Disclosure

The disclosure relates to securement devices and more particularly pertains to a new securement device for preventing electrical cords from being unintentionally uncoupled.

SUMMARY OF THE DISCLOSURE

An embodiment of the disclosure meets the needs presented above by generally comprising a planar, flexible, L-shaped cable tie. Apertures extend through a first arm and openings extend through a second arm of the cable tie. A first hook extends from the second arm for being engaged to a selectable one of the apertures of an adjacently positioned second cable tie. A second hook extends from the second arm proximate a junction between the first arm and the second arm such that the second hook is engageable to one of the openings to form a loop configured for extending around an electrical cord adjacent to a plug of the electrical cord such that the plug is prevented from passing through the loop.

There has thus been outlined, rather broadly, the more important features of the disclosure in order that the detailed description thereof that follows may be better understood, and in order that the present contribution to the art may be better appreciated.

There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
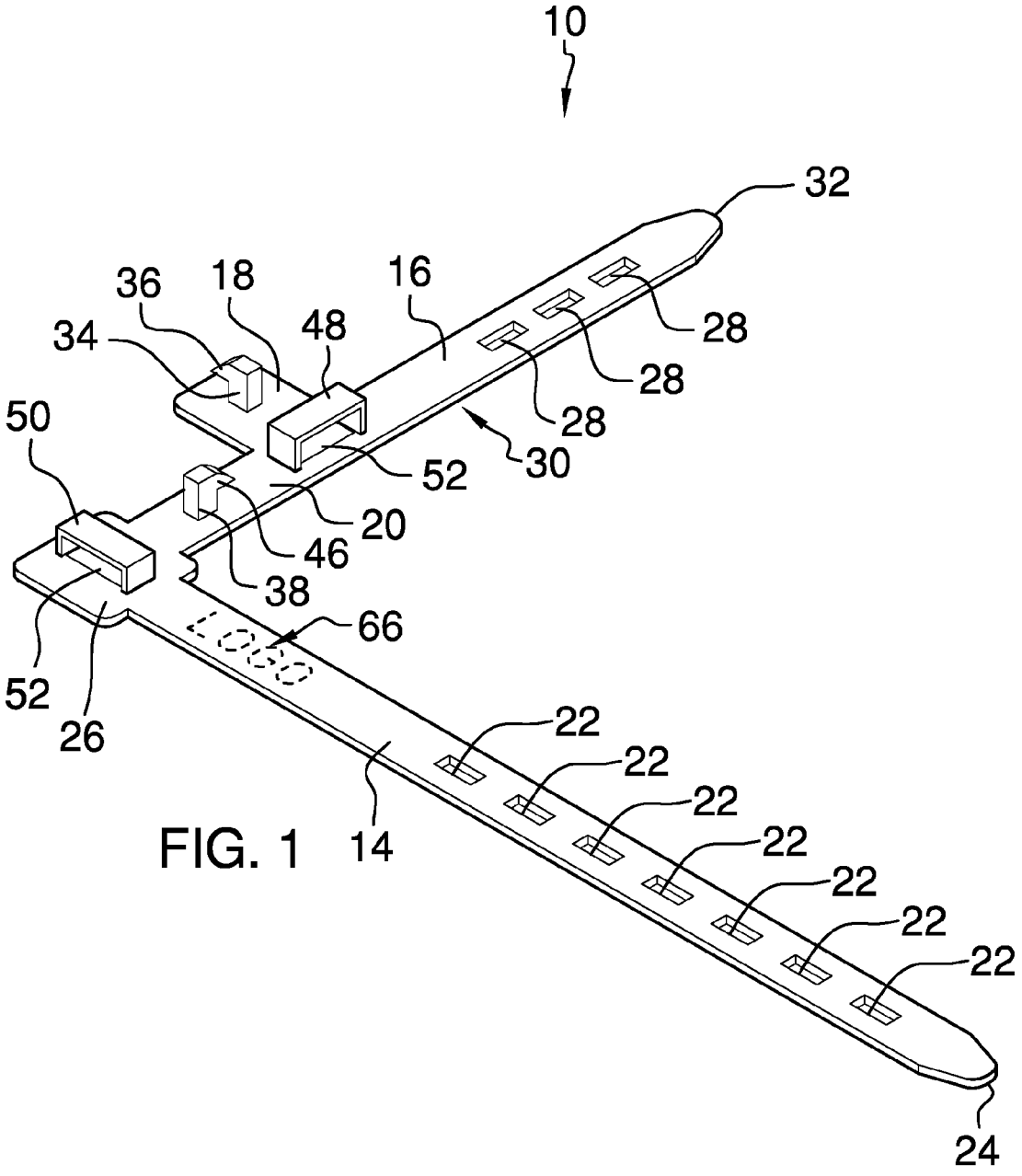
FIG. 1 is a top front side perspective view of a cord connection securement device according to an embodiment of the disclosure.
Figure 2:
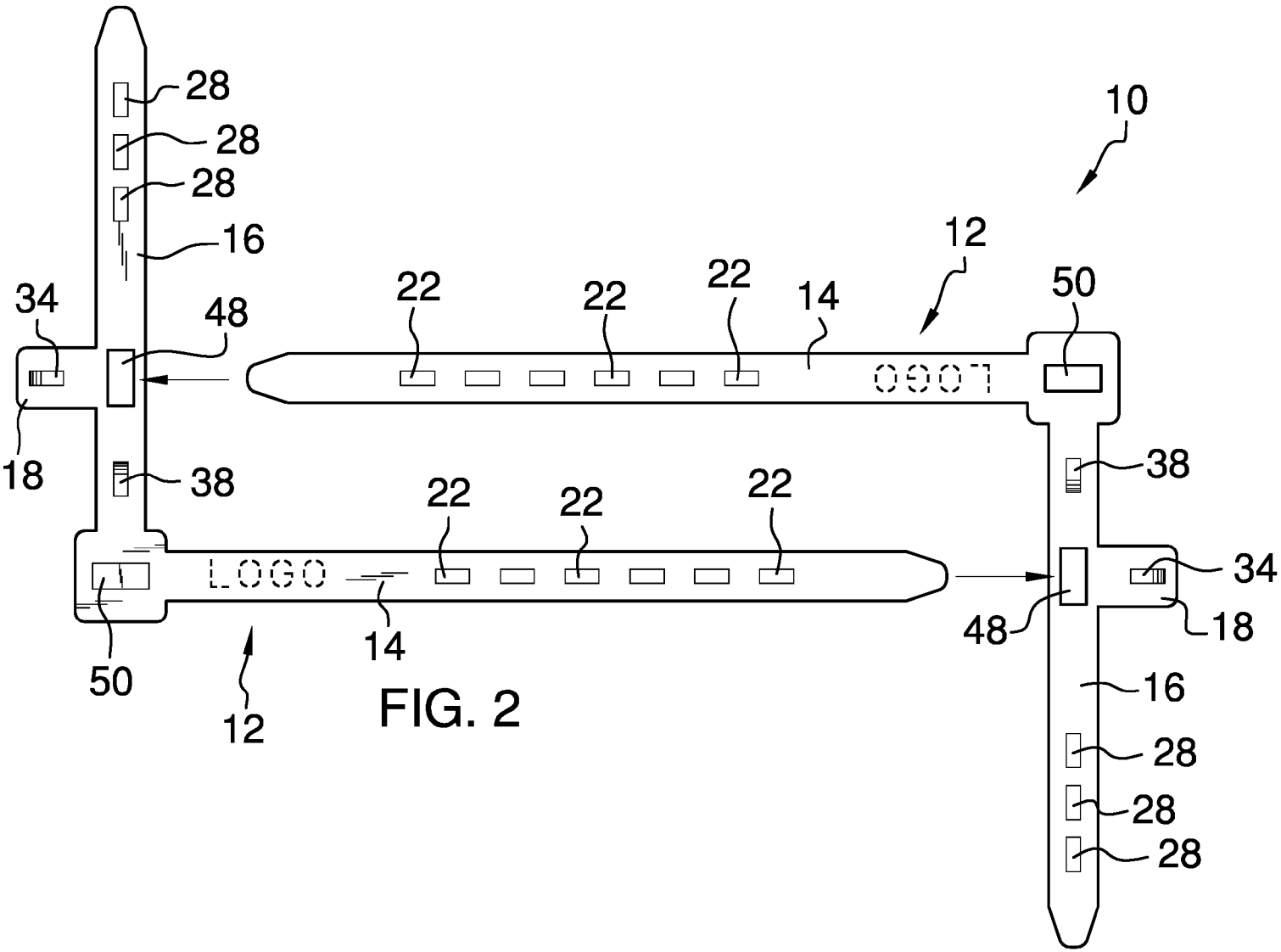
FIG. 2 is top view of an embodiment of the disclosure.
Figure 3:
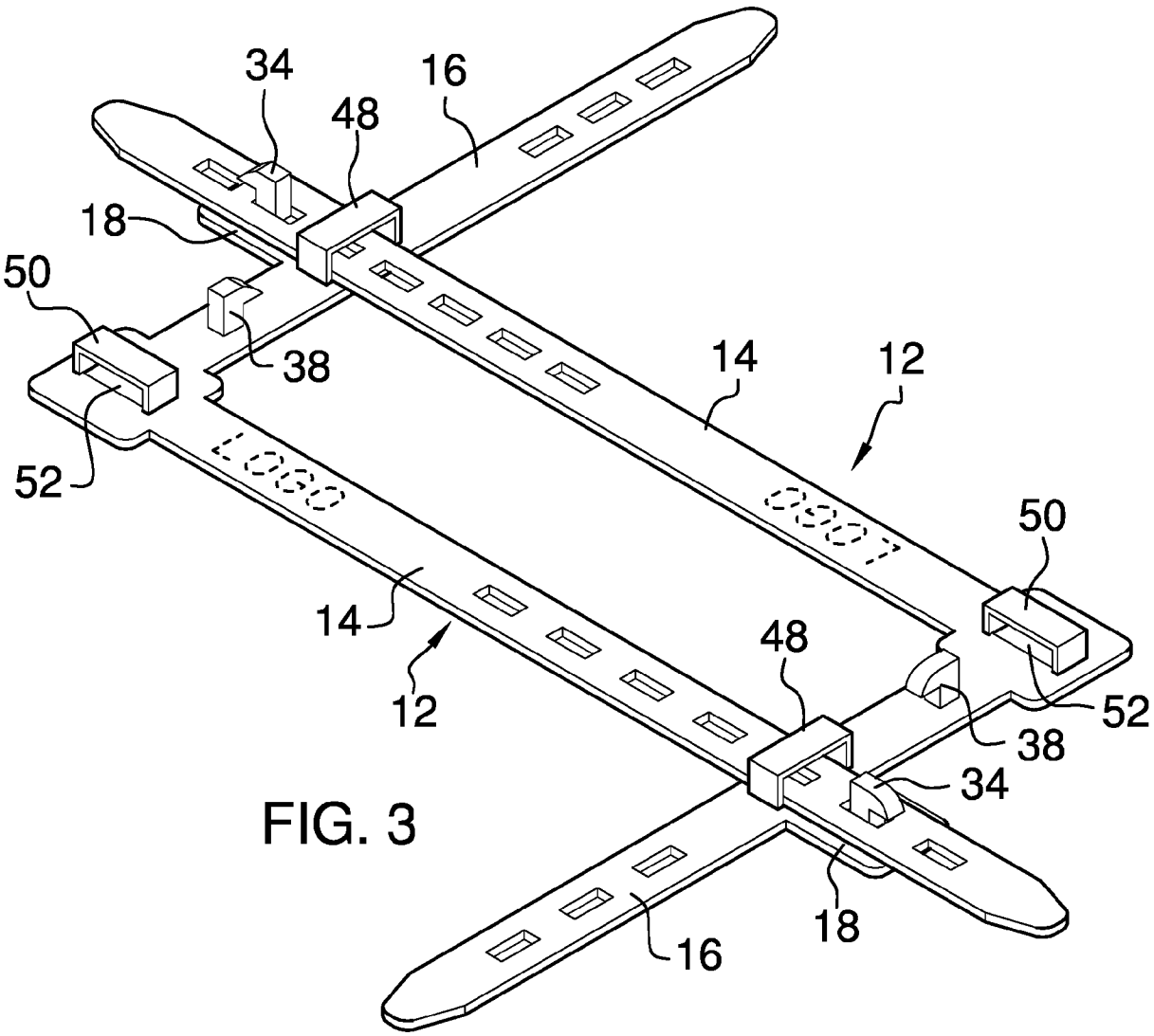
FIG. 3 is a top front side perspective view of an embodiment of the disclosure.
Figure 4:
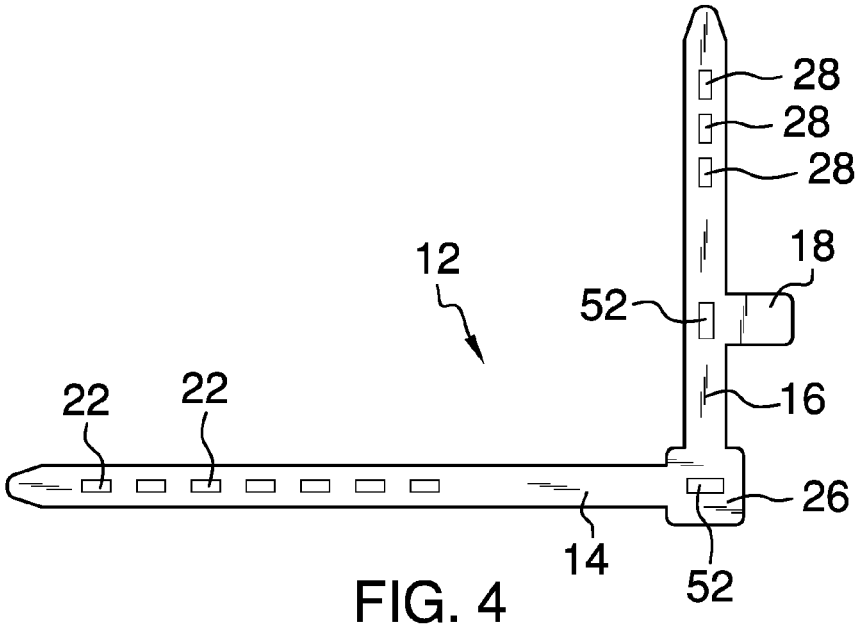
FIG. 4 is a bottom view of an embodiment of the disclosure.
Figure 5:
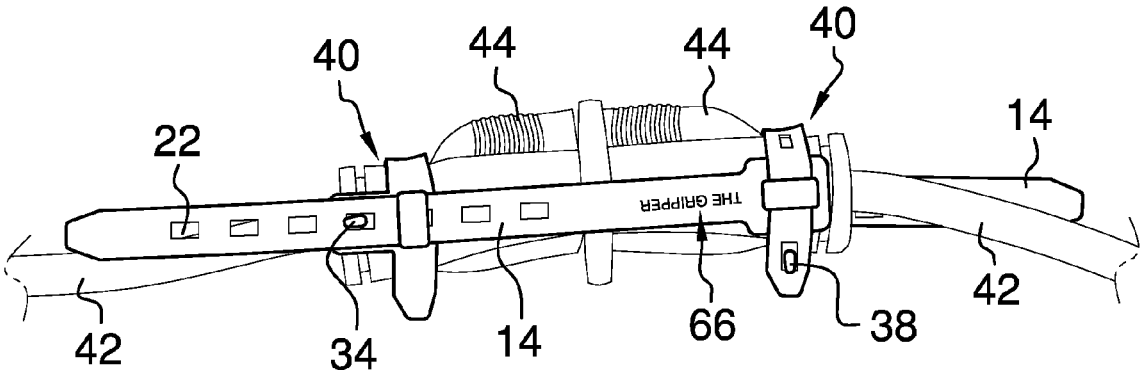
FIG. 5 is a front view of an embodiment of the disclosure in use.

With reference now to the drawings, and in particular to FIGS. 1 through 5 thereof, a new securement device embodying the principles and concepts of an embodiment of the disclosure and generally designated by the reference numeral 10 will be described.

As best illustrated in FIGS. 1 through 5, the cord connection securement device 10 generally a pair of cable ties 12. Each of the cable ties 12 is planar and has a respective first arm 14 and a respective second arm 16. The first arm 14 is perpendicular to the second arm 16 such that each cable tie 12 is substantially L-shaped. Each cable tie 12 is flexible and planar in an uncoupled or relaxed state. The second arm 16 of each cable tie 12 includes a respective tab 18 extending outwardly from an elongated main section 20 of the second arm 16. The tab 18 extends in an opposite direction from the first arm 14.

A respective plurality of apertures 22 extends through the first arm 14 of each cable tie 12. The apertures 22 of each cable tie 12 are aligned along a central axis of the first arm 14. The apertures 22 on each cable tie 12 are evenly spaced extending from a distal end 24 of the first arm 14 relative to the second arm 16 towards a junction 26 of the first arm 14 and the second arm 16.

A respective plurality of openings 28 extends through the second arm 16 of each cable tie 12. The openings 28 on each cable tie 12 are aligned along a central axis of the second arm 16 and the openings 28 on each cable tie 12 are positioned between a center 30 of the second arm 16 and a distal end 32 of the second arm 16 relative to the first arm 14. The openings 28 of each cable tie 12 are evenly spaced along the second arm 16. There may be exactly three openings 28.

Each of a pair of first hooks 34 is coupled to and extends from the second arm 16 of an associated one of the cable ties 12. Each first hook 34 is positioned on the tab 18 of the associated cable tie 12. Each first hook 34 is positioned in spaced relationship to the junction 26 between the first arm 14 and the second arm 16 of the associated cable tie 12. Thus, the first hook 34 of each cable tie 12 is engageable to a selectable one of the apertures 22 on the other cable tie 12 wherein the pair of cable ties 12 are coupled together. Each first hook 34 has a first hook barb 36 facing outwardly relative to the second arm 16 of the associated cable tie 12 and in an opposite direction to the first arm 14 of the associated cable tie 12.

Each of a pair of second hooks 38 is coupled to and extends from the second arm 16 of the associated one of the cable ties 12 proximate the junction 26 between the first arm 14 and the second arm 16 of the associated cable tie 12. Thus, the second hook 38 of each cable tie 12 is engageable to a selectable one of the openings 28 on the associated cable tie 12 to form respective loops 40 configured for extending around respective electrical cords 42 adjacent to respective plugs 44 of the electrical cords 42 such that the loops 40 inhibit uncoupling of the plugs 44 from each other. Each second hook 38 has a second hook barb 46 facing the distal end 32 of the second arm 16 relative to the first arm 14 of the associated cable tie 12.

Each of a pair of first collars 48 is coupled to the second arm 16 of an associated one of the cable ties 12. Each first collar 48 is positioned in lateral alignment with the first hook 34 coupled to the associated cable tie 12 wherein each first collar 48 is configured for receiving therethrough the first arm 14 of the other cable tie 12.

Each of a pair of second collars 50 is coupled to an associated one of the cable ties 12. Each second collar 50 is positioned on the junction 26 between the first arm 14 and the second arm 16 of the associated cable tie 12. Each second collar 50 receives the second arm 16 of the associated cable tie 12 therethrough and is in alignment with the second hook 38 of the associated cable tie 12 wherein each second collar 50 inhibits disengagement of the second arm 16 of the associated cable tie 12 from the second hook 38 of the associated cable tie 12.

Each of the first collars 48 and second collars 50 has an associated aligned hole 52 extending through the associated cable tie 12 facilitating manufacture of the cable ties 12. A logo 66 or other indicia may be positioned on each cable tie 12.

In use, each cable tie 12 is coupled to a respective one of the electrical cords 42 by forming loops 40 adjacent to the electrical plugs 44. The cable ties 12 are then coupled together by engaging each first arm 14 to the first hook 34 of the other cable tie 12. Thus, the loops 40 are prevented from being move apart and provide a physical barrier to separation of the electrical plugs 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A cord connection securement device comprising:

a cable tie, said cable tie being planar and having first arm and a second arm, said first arm being perpendicular to said second arm such that said cable tie is substantially L-shaped, said cable tie being flexible;

a plurality of apertures extending through said first arm;

a plurality of openings extending through said second arm;

a first hook, said first hook being coupled to and extending from said second arm of said cable tie such that said first hook is configured for being engageable to a selectable one of said apertures of an adjacently positioned second cable tie; and a second hook, said second hook being coupled to and extending from said second arm of said cable tie proximate a junction between said first arm and said second arm of said cable tie such that said second hook is engageable to a selectable one of said openings to form a loop configured for extending around an electrical cord adjacent to a plug of the electrical cord such that the plug is prevented from passing through said loop.

2. A cord connection securement device comprising:

a pair of cable ties, each of said cable ties being planar and having first arm and a second arm, said first arm being perpendicular to said second arm such that each said cable tie is substantially L-shaped, each said cable tie being flexible;

a respective plurality of apertures extending through said first arm of each said cable tie;

a respective plurality of openings extending through said second arm of each said cable tie;

a pair of first hooks, each said first hook being coupled to and extending from said second arm of an associated one of said cable ties; and a pair of second hooks, each said second hook being coupled to and extending from said second arm of an associated one of said cable ties proximate said junction between said first arm and said second arm of said associated cable tie;

wherein said first hook of each cable tie is engageable to a selectable one of said apertures on another said cable tie wherein said pair of cable ties are coupled together; and wherein said second hook of each cable tie is engageable to a selectable one of said openings on said associated cable tie to form respective loops configured for extending around respective electrical cords adjacent to respective plugs of the electrical cords such that said loops inhibit uncoupling of said plugs.

3. The device of claim 2, further comprising said apertures of each cable tie being aligned along a central axis of said first arm.

4. The device of claim 2, further comprising said apertures on each said cable tie being evenly spaced extending from a distal end of said first arm relative to said second arm towards a junction of said first arm and said second arm.

5. The device of claim 2, further comprising said openings on each said cable tie being aligned along a central axis of said second arm.

6. The device of claim 2, further comprising said openings on each said cable tie being positioned between a center of said second arm and a distal end of said second arm relative to said first arm.

7. The device of claim 2, further comprising each said cable tie being planar in an uncoupled state.

8. The device of claim 2, further comprising said openings of each said cable tie being evenly spaced along said second arm.

9. The device of claim 2, further comprising said plurality of openings of each said cable tie being exactly three openings.

10. The device of claim 2, further comprising each said first hook having a first hook barb facing outwardly relative to said second arm of said associated cable tie and in an opposite direction to said first arm of said associated cable tie.

11. The device of claim 2, further comprising each said first hook being positioned in spaced relationship to said junction between said first arm and said second arm of said associated cable tie.

12. The device of claim 2, further comprising a pair of first collars, each said first collar being coupled to said second arm of an associated one of said cable ties, each said first collar being positioned in lateral alignment with said first hook coupled to said associated cable tie wherein each said first collar is configured for receiving therethrough said first arm of said another cable tie.

13. The device of claim 2, further comprising said second arm of each said cable tie including a respective tab extending outwardly from an elongated main section of said second arm, said tab extending in an opposite direction from said first arm, each said first hook being positioned on said tab of said associated cable tie.

14. The device of claim 2, further comprising each said second hook having a second hook barb facing said distal end of said second arm relative to said first arm of said associated cable tie.

15. The device of claim 2, further comprising a pair of second collars, each said second collar being coupled to an associated one of said cable ties, each said second collar being positioned on said junction between said first arm and said second arm of said associated cable tie, each said second collar receiving said second arm of said associated cable tie therethrough and being in alignment with said second hook of said associated cable tie wherein each said second collar inhibits disengagement of said second arm of said associated cable tie from said second hook of said associated cable tie.

16. A cord connection securement device comprising:

a pair of cable ties, each of said cable ties being planar and having first arm and a second arm, said first arm being perpendicular to said second arm such that each said cable tie is substantially L-shaped, each said cable tie being flexible, each said cable tie being planar in an uncoupled state, said second arm of each said cable tie including a respective tab extending outwardly from an elongated main section of said second arm, said tab extending in an opposite direction from said first arm;

a respective plurality of apertures extending through said first arm of each said cable tie, said apertures of each cable tie being aligned along a central axis of said first arm, said apertures on each said cable tie being evenly spaced extending from a distal end of said first arm relative to said second arm towards a junction of said first arm and said second arm;

a respective plurality of openings extending through said second arm of each said cable tie, said openings on each said cable tie being aligned along a central axis of said second arm, said openings on each said cable tie being positioned between a center of said second arm and a distal end of said second arm relative to said first arm, said openings of each said cable tie being evenly spaced along said second arm, said plurality of openings of each said cable tie being exactly three openings;

a pair of first hooks, each said first hook being coupled to and extending from said second arm of an associated one of said cable ties, each said first hook being positioned on said tab of said associated cable tie, each said first hook being positioned in spaced relationship to said junction between said first arm and said second arm of said associated cable tie wherein said first hook of each cable tie is engageable to a selectable one of said apertures on another said cable tie wherein said pair of cable ties are coupled together, each said first hook having a first hook barb facing outwardly relative to said second arm of said associated cable tie and in an opposite direction to said first arm of said associated cable tie;

a pair of second hooks, each said second hook being coupled to and extending from said second arm of an associated one of said cable ties proximate said junction between said first arm and said second arm of said associated cable tie wherein said second hook of each cable tie is engageable to a selectable one of said openings on said associated cable tie to form respective loops configured for extending around respective electrical cords adjacent to respective plugs of the electrical cords such that said loops inhibit uncoupling of said plugs, each said second hook having a second hook barb facing said distal end of said second arm relative to said first arm of said associated cable tie;

a pair of first collars, each said first collar being coupled to said second arm of an associated one of said cable ties, each said first collar being positioned in lateral alignment with said first hook coupled to said associated cable tie wherein each said first collar is configured for receiving therethrough said first arm of said another cable tie; and a pair of second collars, each said second collar being coupled to an associated one of said cable ties, each said second collar being positioned on said junction between said first arm and said second arm of said associated cable tie, each said second collar receiving said second arm of said associated cable tie therethrough and being in alignment with said second hook of said associated cable tie wherein each said second collar inhibits disengagement of said second arm of said associated cable tie from said second hook of said associated cable tie.

* * * * *